US010866548B2

(12) United States Patent
Miyake

(10) Patent No.: US 10,866,548 B2
(45) Date of Patent: Dec. 15, 2020

(54) FIXING DEVICE INCLUDING FIBER MEMBER HAVING OIL REPELLENT PORTION AT FIXING BELT SIDE AND IMAGE FORMING APPARATUS

(71) Applicant: KYOCERA Document Solutions Inc., Osaka (JP)

(72) Inventor: Takashi Miyake, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/596,389

(22) Filed: Oct. 8, 2019

(65) Prior Publication Data

US 2020/0133177 A1 Apr. 30, 2020

(30) Foreign Application Priority Data

Oct. 24, 2018 (JP) ..... 2018-199974

(51) Int. Cl.
*G03G 15/20* (2006.01)

(52) U.S. Cl.
CPC ..... *G03G 15/2053* (2013.01)

(58) Field of Classification Search
CPC ..... G03G 15/2025; G03G 15/2017
See application file for complete search history.

(56) References Cited

U.S. PATENT DOCUMENTS 7,844,208 B2 * 11/2010 Hayashi ..... G03G 15/2025 399/329
10,345,748 B2 * 7/2019 Nagai ..... G03G 15/2053

FOREIGN PATENT DOCUMENTS

JP 2010-217517 A 9/2010

* cited by examiner

*Primary Examiner* — Arlene Heredia
(74) *Attorney, Agent, or Firm* — Studebaker & Brackett PC

(57) ABSTRACT

A fixing device includes a flexible rotatable fixing belt, a pressuring member, a pressing member, a heating part, a belt guide, and a fiber member. The pressuring member forms a pressuring area between the fixing belt and the pressuring member. The pressing member comes into contact with an inner circumference face of the fixing belt via lubricant in the pressuring area to press the fixing belt to the pressuring member. The heating part heats the fixing belt from outside. The belt guide supports the fixing belt from a side of the inner circumference face so that the fixing belt faces to the heating part. The fiber member is arranged between the belt guide and the fixing belt. At least a part of a face of the fiber member at a side of the fixing belt is oil repellent.

8 Claims, 4 Drawing Sheets

FIXING DEVICE INCLUDING FIBER MEMBER HAVING OIL REPELLENT PORTION AT FIXING BELT SIDE AND IMAGE FORMING APPARATUS

INCORPORATION BY REFERENCE

This application is based on and claims the benefit of priority from Japanese Patent application No. 2018-199974 filed on Oct. 24, 2018, the entire contents of which are incorporated herein by reference.

BACKGROUND

The present disclosure relates to a fixing device fixing a toner image on a sheet and an image forming apparatus including this fixing device.

A fixing device may apply a fixing belt heated with electromagnetic induction. The fixing belt is pressed to a pressuring roller by a pressing member to form a pressuring area between the pressuring roller and the fixing belt. When the pressuring roller is rotated, the fixing belt is rotated by following the pressuring roller, and then, a sheet passes through the pressuring area. At that time, a toner image is heated and pressured, and thereby, fixed on the sheet. Between the pressing member and the fixing belt, lubricant is applied, and thereby, the fixing belt is smoothly slid with respect to the pressing member.

Because the fixing belt has flexibility and has low shape maintainability, the fixing belt is supported by a belt guide. The belt guide is arranged in a hollow part of the fixing belt and comes into contact with an inner circumferential face of the fixing belt to make the fixing belt face to the IH heater. In the fixing device having such structure, the lubricant may be leaked from between the pressing member and the fixing belt, be transmitted on the inner circumferential face of the fixing belt, and be inserted between the fixing belt and the belt guide.

In a conventional fixing device, a sliding member may be fixed on a contact face of a heating assistant member (bet guide) coming into contact with a belt member (a fixing belt). The sliding member is a film having porous structure and made of polyimide resin. This sliding member restrains frictional wear of the heating assistant member and the belt member. Moreover, the porous structure stably holds the lubricant and prevents increasing of sliding friction.

However, in the conventional fixing device, the belt member and the heating assistant member may be in close contact with each other via the lubricant inserted in a gap between the belt member and the heating assistant member. Accordingly, friction between the belt member and the heating assistant member may be increased and stick slip may be easy to occur, and consequently, vibration sound may be caused.

SUMMARY

In accordance with an embodiment of the present disclosure, a fixing device includes a flexible rotatable fixing belt, a pressuring member, a pressing member, a heating part, a belt guide, and a fiber member. The pressuring member forms a pressuring area between the fixing belt and the pressuring member. The pressing member comes into contact with an inner circumference face of the fixing belt via lubricant in the pressuring area to press the fixing belt to the pressuring member. The heating part heats the fixing belt from outside. The belt guide supports the fixing belt from a side of the inner circumference face so that the fixing belt faces to the heating part. The fiber member is arranged between the belt guide and the fixing belt. At least a part of a face of the fiber member at a side of the fixing belt is oil repellent.

In accordance with an embodiment of the present disclosure, an image forming apparatus includes an image forming part forming a toner image on a sheet, and the above-described fixing device fixing the toner image on the sheet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, an image forming apparatus and a fixing device according to embodiments of the present disclosure will be described with reference to the drawings.

Figure 1:
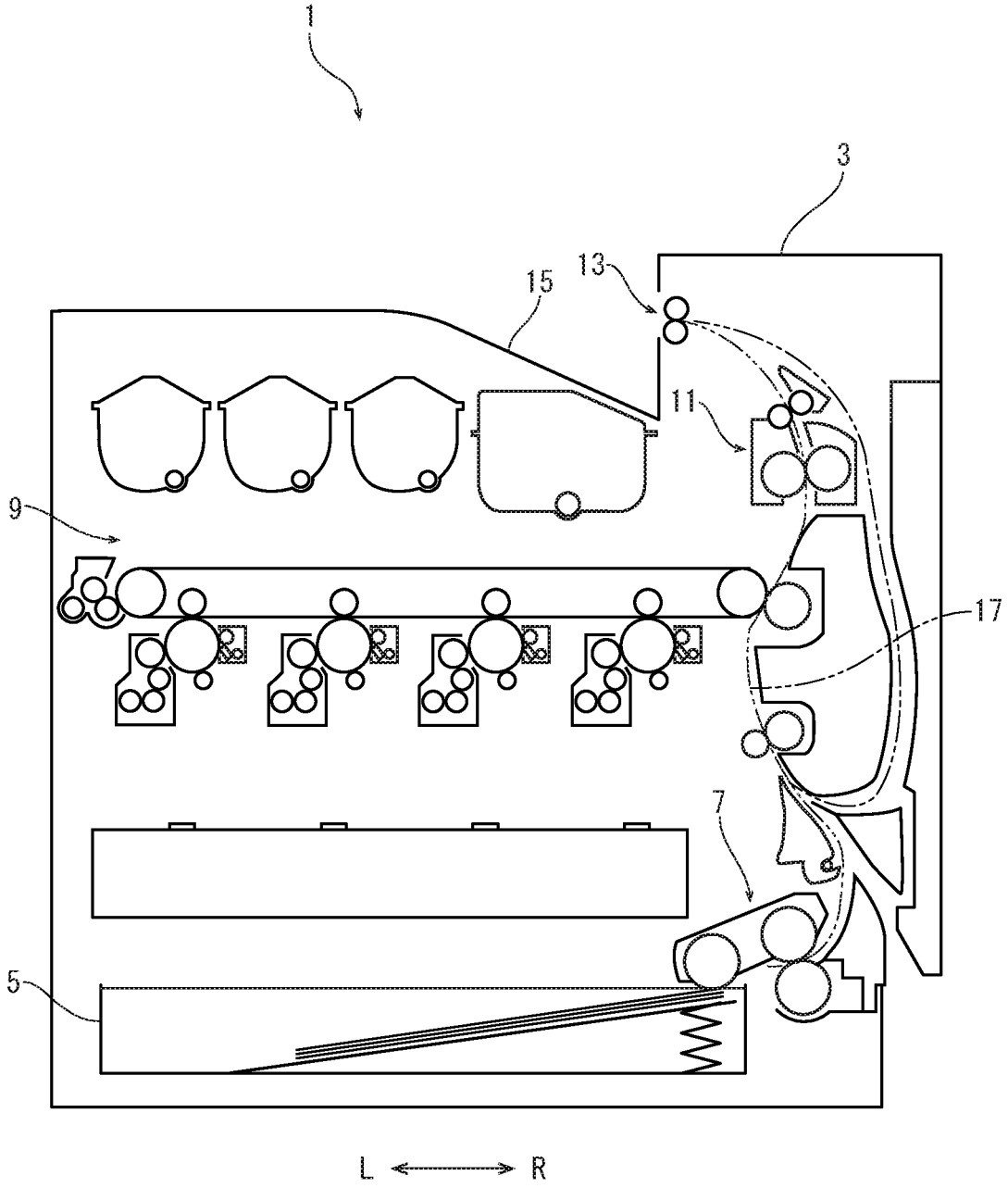
FIG. 1 is a sectional view schematically showing an internal structure an image forming apparatus according to an embodiment of the present disclosure.

First, with reference to FIG. 1, the entire structure of an image forming apparatus 1 (e.g. a printer) will be described. FIG. 1 is a sectional view schematically showing an internal structure the image forming apparatus 1. Hereinafter, it will be described so that the front side of the image forming apparatus 1 is positioned at a near side on a paper sheet of FIG. 1. Arrows L and R in each figure respectively indicate a left side and a right side of the image forming apparatus 1.

An apparatus body 3 of the image forming apparatus 1 is provided with a sheet feeding cartridge 5 in which sheets S are stored, a sheet feeding device 7 feeding the sheet S from the sheet feeding cartridge 5, an image forming part 9 forming a toner image on the sheet S, a fixing device 11 fixing the toner image on the sheet S, a sheet ejecting device 13 ejecting the sheet S, and an ejected sheet tray 15 on which the ejected sheet S is placed. Further, in the apparatus body 3, a conveying path 17 for the sheet S conveyed from the sheet feeding device 7 to the sheet ejecting device 13 via the image forming part 9 and the fixing device 11 is arranged.

The sheet S fed from the sheet feeding cartridge 5 by the sheet feeding device 7 is conveyed along the conveying path 17 to the image forming part 9, and then, the toner image is formed on the sheet S in the image forming part 9. The sheet S is conveyed along the conveying path 17 to the fixing device 11, and then, the toner image is fixed on the sheet S in the fixing device 11. The sheet S having the fixed toner image is ejected from the sheet ejecting device 13 and is placed on the ejected sheet tray 15.

Figure 2:
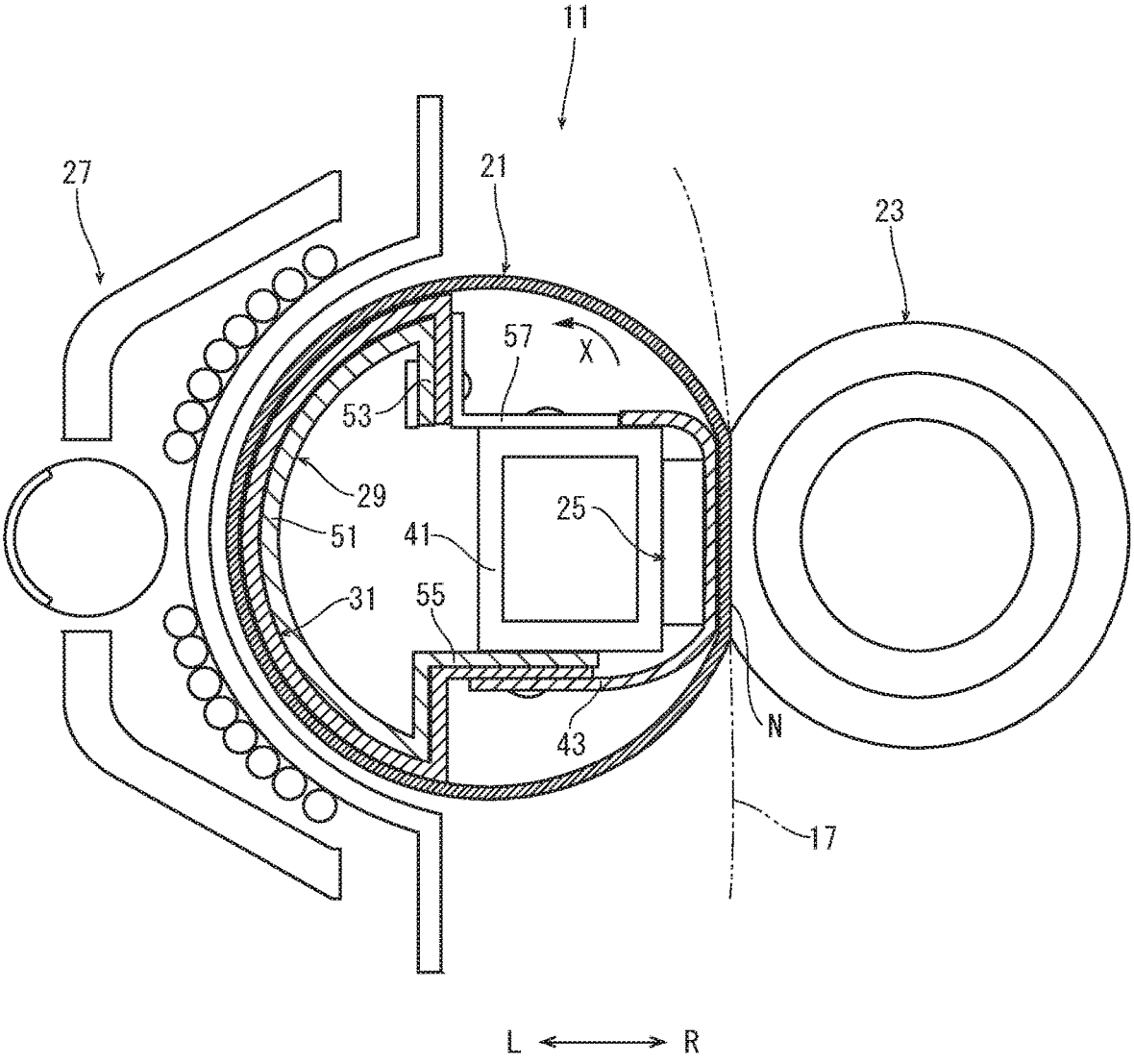
FIG. 2 is a sectional view schematically showing a fixing device according to the embodiment of the present disclosure.

Next, the fixing device 11 will be described with reference to FIG. 2. FIG. 2 is a sectional view schematically showing the fixing device 11.

The fixing device 11 includes an endless fixing belt 21, a pressuring roller 23, a pressing member 25, an IH (Induction Heating) heater 27 as a heating part, a belt guide 29, and a fiber member 31. The pressuring roller 23 is a pressuring member forming a pressuring area N between the fixing belt 21 and the pressuring roller 23. The pressing member 25 presses the fixing belt 21 to the pressuring roller 23 in the pressuring area N. The IH heater 27 is a heating part induction-heating the fixing belt 21. The belt guide 29 supports the fixing belt 21 so that the fixing belt 21 faces to the IH heater 27. The fiber member 31 is arranged between the fixing belt 21 and the belt guide 29.

The fixing belt 21 is an endless belt having a predetermined inner diameter and having a width longer than a sheet passing area on which the sheet S is passed. The inner diameter is, as one example, 20 mm to 50 mm. The fixing belt 21 is made of flexible material and has a base material layer, an elastic layer provided on an outer circumferential face of the base material layer, and a release layer provided on an outer circumferential face of the elastic layer. The base material layer is made of magnetic metal, such as Ni (nickel). A thickness of the base material layer is, as one example, 30 μm. The elastic layer is made of silicon rubber or the like. A thickness of the elastic layer is, as one example, 200 μm. The release layer is made of PFA (Perfluoro alkoxy alkane) tube or the like. A thickness of the release layer is, as one example, 30 μm. On an inner circumferential face of the base material layer, a sliding layer may be formed. The sliding layer is made of polyimideamide, PTFE (polytetrafluoroethylene) or the like.

The fixing belt 21 is rotatably supported by a supporting mechanism (not shown) at its both ends.

The pressuring roller 23 has a core metal, an elastic layer provided on an outer circumferential face of the core metal, and a release layer provided on an outer circumferential face of the elastic layer. The core metal is made of aluminum or the like. The elastic layer is made of silicon rubber or the like. The release layer is made of PFA tube or the like. One end of the core metal is connected to a driving source (not shown), and the pressuring roller 23 is rotatable in a clockwise direction on a paper sheet of FIG. 2 by the driving source (not shown). The pressuring roller 23 is arranged at a lateral side (a right side) of the fixing belt 21 so as to come into contact with the fixing belt 21.

The pressing member 25 is supported by a supporting member 41 provided in a hollow part of the fixing belt 21. The supporting member 41 is a hollow rectangular tube member, and is made of, as one example, non-magnetic material, such as aluminum.

The pressing member 25 is a roughly rectangular parallelepiped member having a width equal to the width of the fixing belt 21, and is made of, for example, a liquid crystal polymer. The pressing member 25 is arranged so as to face to the pressuring roller 23, and comes into contact with the inner circumferential face of the fixing belt 21 to press the fixing belt 21 to the pressuring roller 23. Thereby, the pressuring area N is formed between the fixing belt 21 and the pressuring roller 23. When the pressuring roller 23 is rotated in the clockwise direction on FIG. 2, the fixing belt 21 is rotated in a counterclockwise direction X on FIG. 2 by following the pressuring roller 23, and then, the sheet S conveyed to the pressuring area N along the conveying path 17 is conveyed from a lower side to an upper side in the pressuring area N.

A surface (a face facing to the inner circumferential face of the fixing belt 21) of the pressing member 25 is covered by a sliding sheet 43. Both ends of the sliding sheet 43 in a circumferential direction of the fixing belt 21 are fixed by the supporting member 41. The sliding sheet 43 is made of, for example, a fluororesin sheet. On a surface (a face facing to the inner circumferential face of the fixing belt 21) of the sliding sheet 43, lubricant is applied.

The IH heater 27 includes a coil, a coil bobbin holding the coil in a winding shape, and an arch core. The IH heater 27 is arranged at an opposite side to the pressuring roller 23 with respect to (across) the fixing belt 21, and is supported so as to cover a roughly half (a left half) of the outer circumferential face of the fixing belt 21. When a high frequency AC voltage is applied into the coil, a magnetic flux is generated. When this magnetic flux is passed through the base material layer of the fixing belt 21, eddy current is caused in the base material layer to generate heat in the base material layer, and thereby, the fixing belt 21 is heated.

The belt guide 29 is a member having a spring property, and includes a body part 51 coming into contact with the inner circumferential face of the fixing belt 21, and an upstream side end part 53 and a downstream side end part 55 provided at both ends of the body part 51 in the circumferential direction of the fixing belt 21. The body part 51 has a width (a length in an orthogonal direction to the circumferential direction) broader than a maximum width of the sheet S. The upstream side end part 53 is arranged at an upstream side in a rotation direction X of the fixing belt 21, and the downstream side end part 55 is arranged at a downstream side in the rotation direction X of the fixing belt 21. The body part 51 has an arcuate section along the inner circumferential face of the fixing belt 21. The upstream side end part 53 is bent from one end (an end at the upstream side in the rotation direction X) of the body part 51 to an inward side in a radial direction of the fixing belt 21. The downstream side end part 55 is bent from the other end (an end at the downstream side in the rotation direction X) of the body part 51 to the inward side in the radial direction of the fixing belt 21, and further, bent at right angles toward an opposite side to the body part 51.

The belt guide 29 is arranged in the hollow part of the fixing belt 21 so that the body part 51 faces to the IH heater 27, and is supported by the supporting member 41 with a cantilever type. That is, the downstream side end part 55 is fixedly attached to the supporting member 41 at the inside of the sliding sheet 43, and the upstream side end part 53 is supported by a fixing member 57 fixedly attached to the supporting member 41 so as to be movable in upward and downward directions. Thereby, the belt guide 29 swings around the downstream side end part 55, and applies tension to the fixing belt 21.

Figure 3:
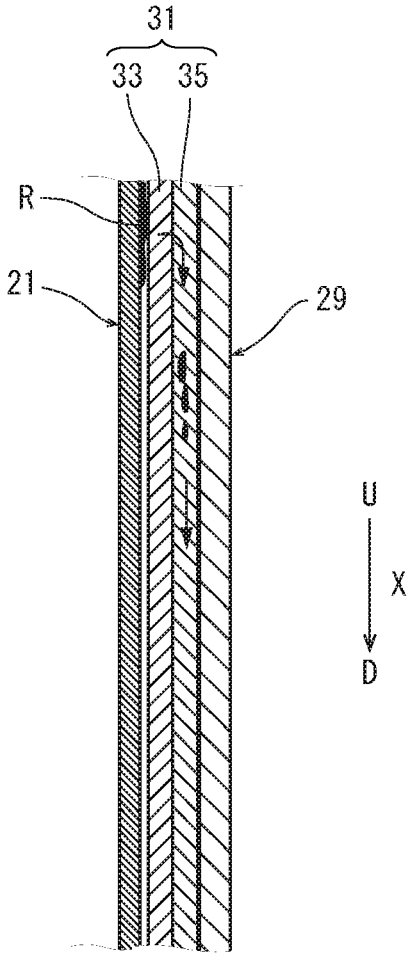
FIG. 3 is a sectional view schematically showing a fiber member according to a first embodiment, in the fixing device according to the embodiment of the present disclosure.

Next, with reference to FIG. 3, the fiber member 31 according to the first embodiment will be described. FIG. 3 is a sectional view schematically showing the fiber member 31.

The fiber member 31 is woven fabric made by double weaving of an oil repellent fiber 33 and an oil non-repellent fiber 35. In detail, in the fiber member 31, the oil repellent fiber 33 is exposed to a surface, and the oil non-repellent fiber 35 is exposed to a back face. By weaving the fibers in such a manner, the surface and the back face of the fiber member 31 are formed in a non-smooth uneven shape. The oil repellent fiber 33 is, for example, a fluororesin fiber, and the oil non-repellent fiber 35 is, for example, a polyphenylene sulfide (PPS) fiber or a glass fiber. A width of the fiber member 31 is broader than a width (a length in an orthogonal direction to the circumferential direction) of the belt guide 29, and the fiber member 31 is protruded from both ends of the belt guide 29 to an outward side. Moreover, the width of the fiber member 31 is narrower than the width of the fixing belt 21.

The fiber member 31 is wound along a surface of the body part 51 of the belt guide 29 in a state that the oil repellent fiber 33 at the surface's side faces to a side of the fixing belt 21 and the oil non-repellent fiber 35 at the back face's side faces to a side of the belt guide 29. Both ends of the fiber member 31 are fixedly attached to both end parts 53 and 55 of the belt guide 29, respectively.

Fixing operation of the fixing device 11 having above-described structure will be described. First, the IH heater 27 is driven to generate the magnetic flux, and the fixing belt 21 is heated by the eddy current caused when this magnetic flux is passed through the base material layer of the fixing belt 21. The fixing belt 21 is heated until predetermined control temperature (e.g. 160 degree centigrade) is reached. Further, the pressuring roller 23 is driven by the driving source to rotate. Then, the fixing belt 21 is rotated in the counter-clockwise direction on FIG. 2 by following the pressuring roller 23 in the pressuring area N.

After the fixing belt 21 is heated, the sheet S having the transferred toner image is conveyed to the pressuring area N. The sheet S is heated by the fixing belt 21 and pressured by the pressuring roller 23 and the fixing belt 21 during passing through the pressuring area N, and then, the toner image is fixed on the sheet S. The sheet S having the fixed toner image is conveyed from the pressuring area N along the conveying path 17.

The fixing belt 21 is rotated in the pressuring area N during sliding with respect to the pressing member 25 (the sliding sheet 43) via the lubricant. The fixing belt 21 is guided by the belt guide 29 at a side facing to the IH heater 27. At this time, as shown in FIG. 3, the lubricant R leaked from the pressuring area N moves to the fiber member 31 covering the belt guide 29 through the inner circumferential face of the fixing belt 21. The lubricant R moved to the fiber member 31 passes through the oil repellent fiber 33 at the surface's side, and then, moves to the oil non-repellent fiber 35 at the back face's side and soaks into the oil non-repellent fiber 35. Because the lubricant R soaked into the oil non-repellent fiber 35 hardly moves to the oil repellent fiber 33 at the surface's side, the lubricant R moves downwardly through the oil non-repellent fiber 35 by capillary phenomenon or gravity.

Subsequently, when the lubricant R reaches a lower end of the body part 51 of the belt guide 29, the lubricant R seeps out of the oil non-repellent fiber 35 by contact pressure between the fixing belt 21 and the body part 51, passes through the oil repellent fiber 33, and is fed to the inner circumferential face of the fixing belt 21. That is, because the belt guide 29 is fixed by fixing the downstream side end part 55 to the supporting member 41 and the belt guide 29 swings around the downstream side end part 55, the belt guide 29 is pressed to the fixing belt stronger, the closer to a lower end side of the body part 51. Therefore, in the lower end of the body part 51, the lubricant is easy to seep out of the oil non-repellent fiber 35 by contact pressure between the fixing belt 21 and the body part 51. The lubricant thus fed to the inner circumferential face of the fixing belt 21 is fed to the pressuring area N by rotation of the fixing belt 21 again.

As explained above, in accordance with the fixing device 11 of the present disclosure, since the oil repellent fiber 33 is exposed to the surface of the fiber member 31 covering the belt guide 29, it is possible to maintain quantity of the lubricant existing between the fixing belt 21 and a sliding face (the surface of the fiber member 31) with respect to the fixing belt 21 in small quantity. Thereby, it is possible to decrease friction between the fixing belt 21 and the sliding face with respect to the fixing belt 21. Therefore, it is possible to stably rotate the fixing belt 21 along the belt guide 29 (the fiber member 31) and to prevent occurrence of vibration sound due to stick slip. Further, since the lubricant leaked from the pressuring area N through the inner circumferential face of the fixing belt 21 circulates by being fed to the inner circumferential face of the fixing belt 21 through the fiber member 31 again, it is possible to prevent exhaustion of the lubricant without causing leakage of the lubricant due to excessive supply. Particularly, the fiber member 31 not only can hold the soaked lubricant, but also can make the lubricant move along the fiber by capillary phenomenon, and accordingly, it is possible to activate circulation of the lubricant. Therefore, it is possible to improve durability of the fixing device 11.

Further, since the fiber member 31 is woven fabric made by weaving of the fiber and has the non-smooth uneven shape, it is possible to decrease a contact area between the inner circumferential face of the fixing belt 21 and the fiber member 31. Therefore, it is possible to decrease friction between the fixing belt 21 and the fiber member 31.

Moreover, as described above, the fiber member 31 has the broader width than the width of the belt guide 29 and is protruded from both ends of the belt guide 29. Further, the fiber member 31 has the narrower width than the width of the fixing belt 21. Thereby, it is possible to protect edges of both ends of the belt guide 29 in the width direction and to feed the lubricant to a necessary range of the fixing belt 21.

Although, in the embodiment, the fiber member 31 is made by double weaving so that the oil repellent fiber 33 is exposed to the surface, and the oil non-repellent fiber 35 is exposed to the back face. However, the fiber member 31 may be woven fabric made by weaving so that the oil repellent fiber 33 is exposed to a part of the surface. Moreover, as the other fiber than the oil repellent fiber 33, a fiver having the other property than non-repellent may be applied. Further, instead of woven fabric, nonwoven fabric is applied. Incidentally, woven fabric is preferable because uneven shape of the surface decreases friction to the fixing belt 21.

Figure 4:
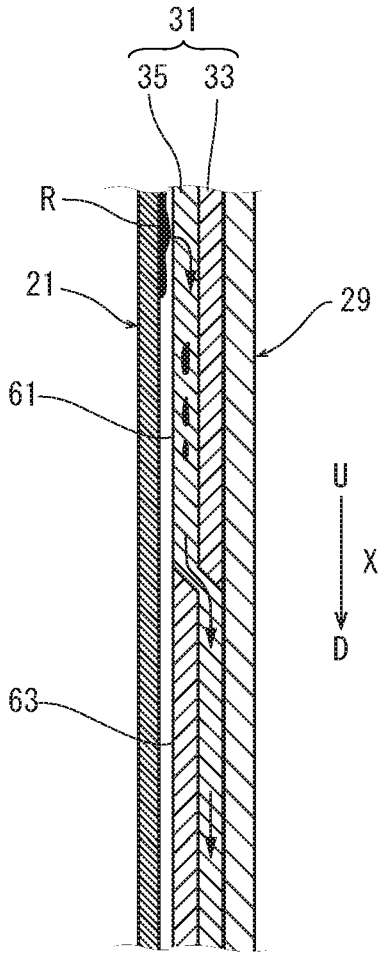
FIG. 4 is a sectional view schematically showing a fiber member according to a second embodiment, in the fixing device according to the embodiment of the present disclosure.

Next, with reference to FIG. 4, the fiber member 31 according to a second embodiment will be described. FIG. 4 is a sectional view schematically showing the fiber member 31.

The fiber member 31 includes an upstream side part 61 at the upstream side in the rotation direction X of the fixing belt 21 and a downstream side part 63 at the downstream side from the upstream side. The upstream side part 61 is made by double weaving so that the oil non-repellent fiber 35 is exposed to the side of the fixing belt 21 and the oil repellent fiber 33 is exposed to the of the belt guide 29. The downstream side part 63 is made by double weaving so that the oil repellent fiber 33 is exposed to the side of the fixing belt 21 and the oil non-repellent fiber 35 is exposed to the of the belt guide 29. Further, the oil non-repellent fiber 35 of the upstream side part 61 and the oil non-repellent fiber 35 of the downstream side part 63 are connected.

When the fixing belt 21 is guided along the belt guide 29, the lubricant R moved from the inner circumferential face of the fixing belt 21 to the fiber member 31 covering the belt guide 29 firstly moves to the oil non-repellent fiber 35 of the upstream side part 61 and soaks into this oil non-repellent fiber 35. Because the lubricant R soaked into this oil non-repellent fiber 35 hardly moves to the oil repellent fiber 33 at the back face's side, the lubricant R moves downwardly by capillary phenomenon or gravity to move to the oil non-repellent fiber 35 of the downstream side part 63, and then, moves further downwardly. Subsequently, when the lubricant R reaches the lower end of the body part 51 of the belt guide 29, the lubricant R seeps out of the oil non-repellent fiber 35 by contact pressure between the fixing belt 21 and the body part 51, and is fed to the inner circumferential face of the fixing belt 21 through the oil repellent fiber 33. And then, the lubricant R is fed to the pressuring area N by rotation of the fixing belt 21 again.

In accordance with the second embodiment, in the upstream side part 61, since the oil non-repellent fiber 35 is exposed to the side of the fixing belt 21, the lubricant R adhered on the inner circumferential face of the fixing belt 21 moves to and soaks into this oil non-repellent fiber 35, and moves through the oil non-repellent fiber 35. Thus, it is possible to move as much lubricant R as possible from the inner circumferential face of the fixing belt 21 to the oil non-repellent fiber 35. On the other hand, in the downstream side part 63, since the oil repellent fiber 33 is exposed to the side of the fixing belt 21, it is possible to maintain quantity of the lubricant R existing between the fixing belt 21 and the fiber member 31 in small quantity. Therefore, it is possible to decrease friction between the fiber member 31 and the fixing belt 21. Further, since the lubricant R moved to the oil non-repellent fiber 35 in the upstream side part 61 moves through the oil non-repellent fiber 35 of the downstream side part 63 and is fed to the inner circumferential face of the fixing belt 21 at the lower end of the body part 51, it is possible to more smoothly circulate the lubricant R leaked from the pressuring area N through the inner circumferential face of the fixing belt 21.

The technical scope of the present disclosure is not limited to above-described aspects unless specifically described to limit the present disclosure.

The invention claimed is:

1. A fixing device comprising:

a flexible rotatable fixing belt;

a pressuring member forming a pressuring area between the fixing belt and the pressuring member;

a pressing member coming into contact with an inner circumference face of the fixing belt via lubricant in the pressuring area to press the fixing belt to the pressuring member;

a heating part heating the fixing belt from outside;

a belt guide supporting the fixing belt from a side of the inner circumference face so that the fixing belt faces to the heating part; and a fiber member arranged between the belt guide and the fixing belt, wherein at least a part of a face of the fiber member at a side of the fixing belt is oil repellent, wherein the fiber member is woven fabric made by weaving a plurality of fibers including an oil repellent fiber, and the fiber member is woven so that the oil repellent fiber is exposed to at least a part of a face of the fiber member at a side of the fixing belt, one of the plurality of fibers is an oil non-repellent fiber, the fiber member includes:

an upstream side part woven so that the oil non-repellent fiber is exposed to a side of the fixing belt and the oil repellent fiber is exposed to a side of the belt guide; and a downstream side part arranged at a downstream side from the upstream side part in a rotation direction of the fixing belt, and woven so that the oil repellent fiber is exposed to a side of the fixing belt and the oil non-repellent fiber is exposed to a side of the belt guide, the oil non-repellent fiber of the upstream side part and the oil non-repellent fiber of the downstream side part are connected.

2. The fixing device according to claim 1, wherein a surface and a back face of the fiber member is formed in a non-smooth uneven shape.

3. An image forming apparatus comprising:

an image forming part forming a toner image on a sheet; and the fixing device according to claim 2 fixing the toner image on the sheet.

4. The fixing device according to claim 1, wherein the fiber member has a width broader than a width of the belt guide.

5. An image forming apparatus comprising:

an image forming part forming a toner image on a sheet; and the fixing device according to claim 4 fixing the toner image on the sheet.

6. The fixing device according to claim 1, wherein the belt guide is fixed at a downstream side in a rotation direction of the fixing belt.

7. An image forming apparatus comprising:

an image forming part forming a toner image on a sheet; and the fixing device according to claim 6 fixing the toner image on the sheet.

8. An image forming apparatus comprising:

an image forming part forming a toner image on a sheet; and the fixing device according to claim 1 fixing the toner image on the sheet.

* * * * *